US005620243A

United States Patent [19]

Billingham

[11] Patent Number: 5,620,243

[45] Date of Patent: Apr. 15, 1997

[54] MODULAR FILING & STORAGE SYSTEM

[76] Inventor: Paul R. Billingham, 22 Heathfield Terrace, Chiswick, London W4 4JE, England

[21] Appl. No.: 307,610

[22] PCT Filed: Mar. 18, 1993

[86] PCT No.: PCT/GB93/00553

§ 371 Date: Jan. 6, 1995

§ 102(e) Date: Jan. 6, 1995

[87] PCT Pub. No.: WO93/18977

PCT Pub. Date: Sep. 30, 1993

[30] Foreign Application Priority Data

Mar. 20, 1992 [GB] United Kingdom ..... 9206049

[51] Int. Cl.[6] ..... A47B 43/00; B65D 5/52

[52] U.S. Cl. ..... 312/259; 206/45.21; 206/45.29; 229/115

[58] Field of Search ..... 312/259, 260, 312/261; 206/45.21, 45.25, 45.29; 229/115, 103

[56] References Cited

U.S. PATENT DOCUMENTS

| | | | |
|---|---|---|---|
| 2,588,377 | 3/1952 | Frankenstein | 206/45.21 |
| 2,916,194 | 12/1959 | Frankenstein | 206/45.21 |
| 3,006,527 | 10/1961 | Lofquist et al. | 229/115 |
| 3,173,596 | 3/1965 | Aust et al. | 229/115 X |
| 4,121,752 | 10/1978 | Rauotto et al. | 229/115 X |
| 4,306,658 | 12/1981 | Montealegne | 229/103 X |
| 4,413,726 | 11/1983 | Davidson | 206/45.29 X |
| 5,007,530 | 4/1991 | Weismantel | 206/45.21 |

FOREIGN PATENT DOCUMENTS

| | | | |
|---|---|---|---|
| 1516166 | 1/1968 | France | 206/45.21 |
| 2622544 | 5/1989 | France | 229/115 |

*Primary Examiner*—Peter M. Cuomo
*Assistant Examiner*—James O. Hansen
*Attorney, Agent, or Firm*—Fay, Sharpe, Beall, Fagan, Minnich & McKee

[57] ABSTRACT

A blank for constructing a box file, card index box, or the like which, in the made up form includes a pair of similar half shells hinged together along a common edge. The blank includes a pair of base members each having outwardly extending side portions on at least three sides which can be bent up to form side walls. Each side portion is joined to the adjacent side portion by an inwardly foldable connection section which is adapted to form a right angled corner when the blank is folded into shape. An interconnecting or stacking system for the file storing boxes is also provided. The stacking system includes a connector body having a slot or aperture and a generally U-shaped clip member having a pair of legs. Each leg of the clip is adapted to fit in a respective slot of the connector body. When two such connector bodies are suitably positioned in the adjacent walls of two corresponding boxes, the boxes may be clipped together by inserting the legs of the clip member into the adjacent slots.

9 Claims, 12 Drawing Sheets

FIG.9.
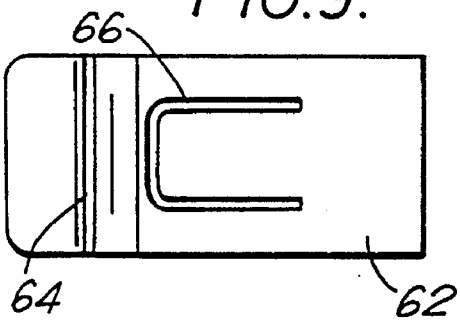
FIG.10.
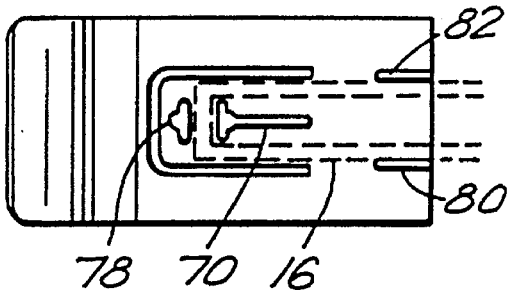
FIG.11.
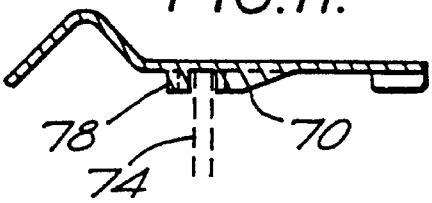
FIG.12.
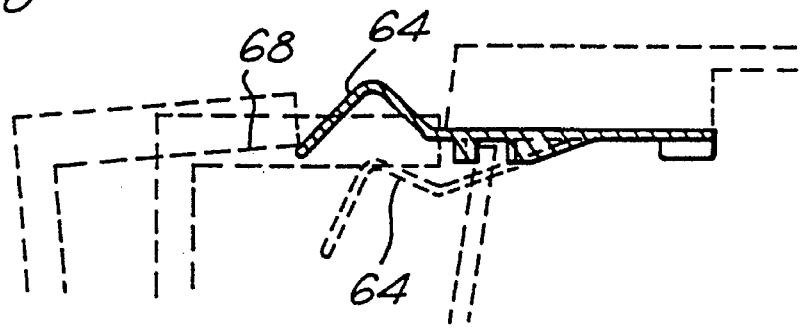
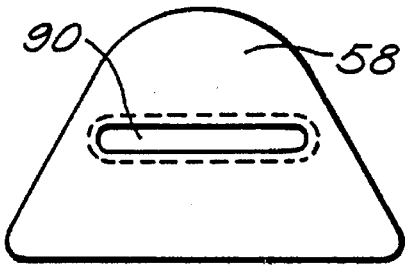
FIG.13.
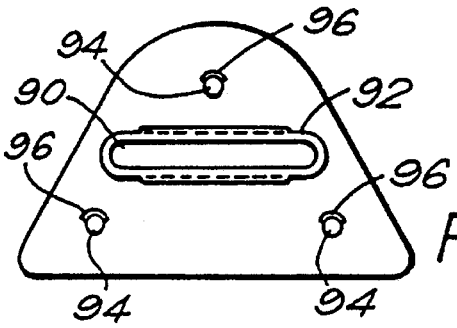
FIG.14.
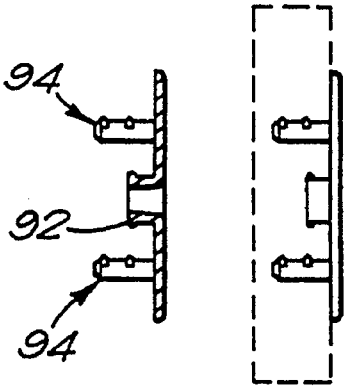
FIG.15.

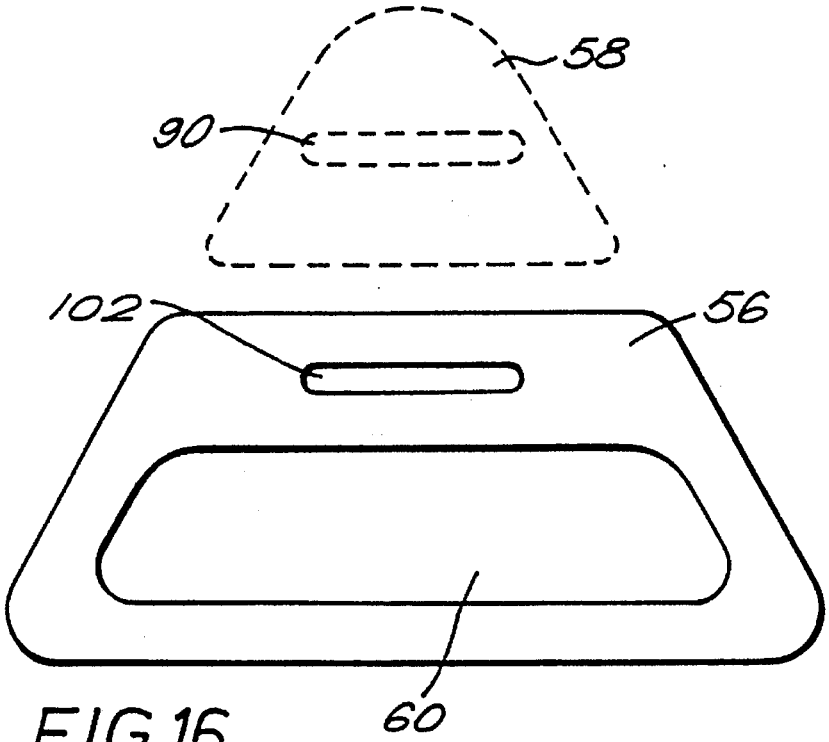
FIG.16.
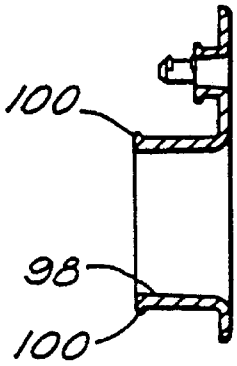
FIG.18.
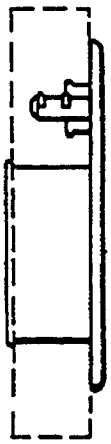
FIG.17.
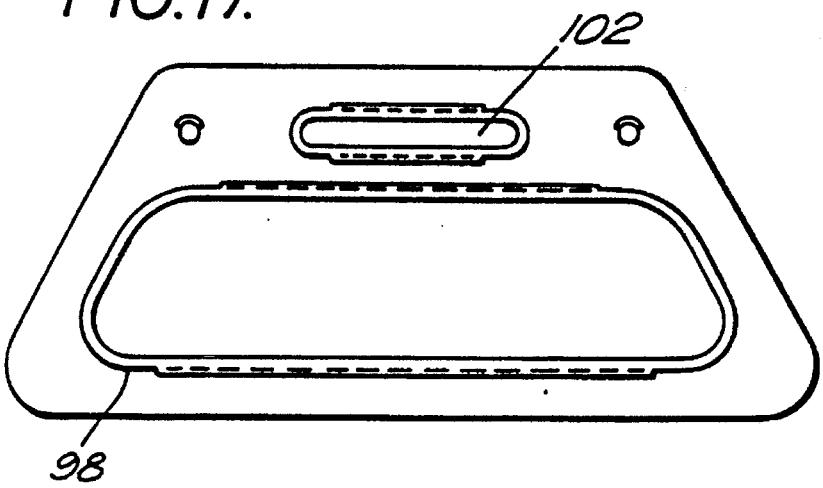

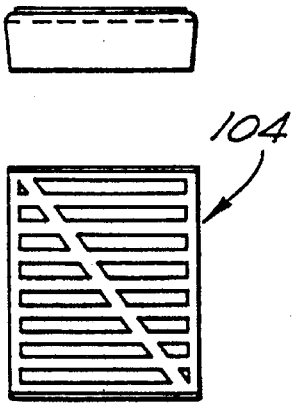
FIG.19.
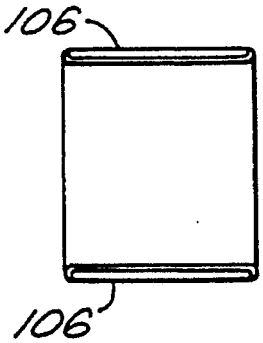
FIG.20.
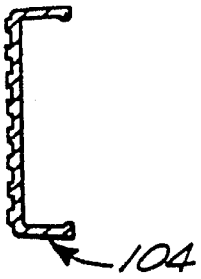
FIG.21.
FIG.23.
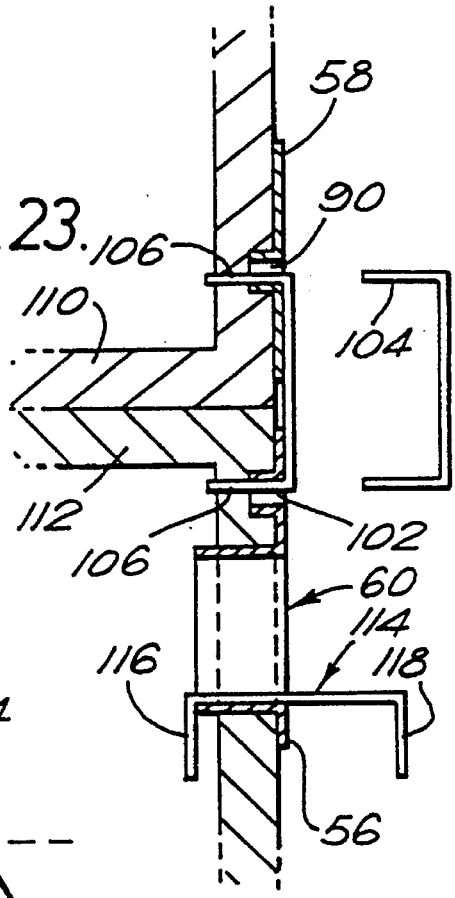
FIG.22.
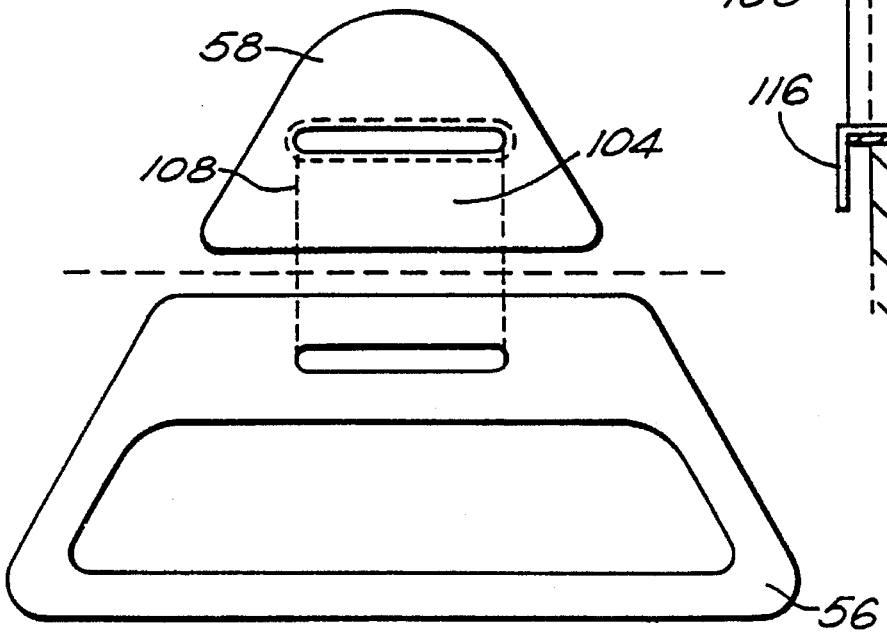

FIG.26.
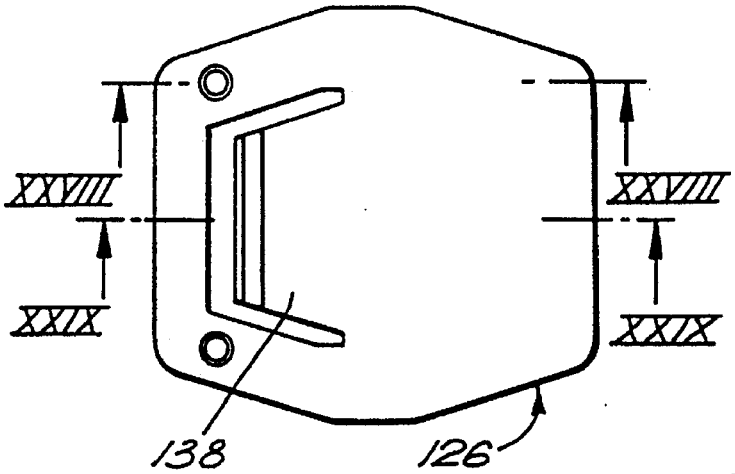
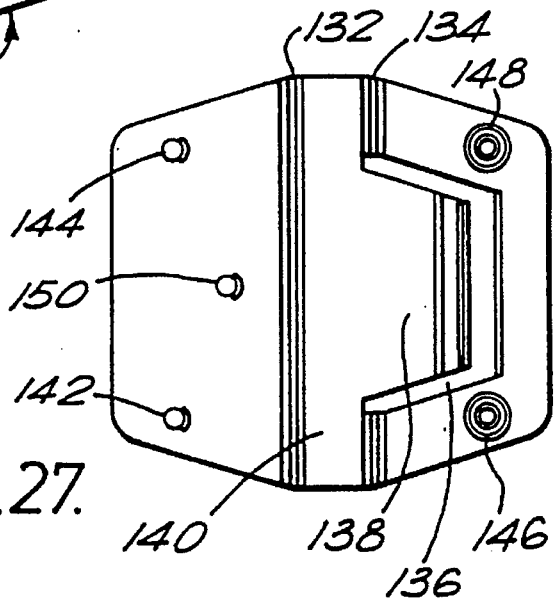
FIG.27.
FIG.28.
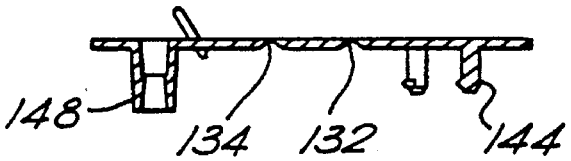
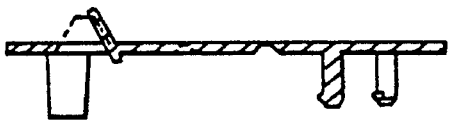
FIG.29.
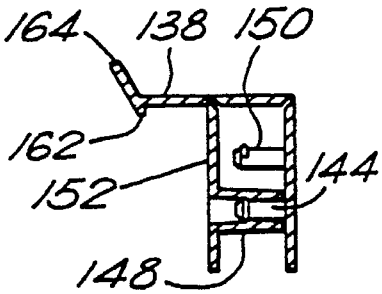
FIG.30.

FIG. 31.
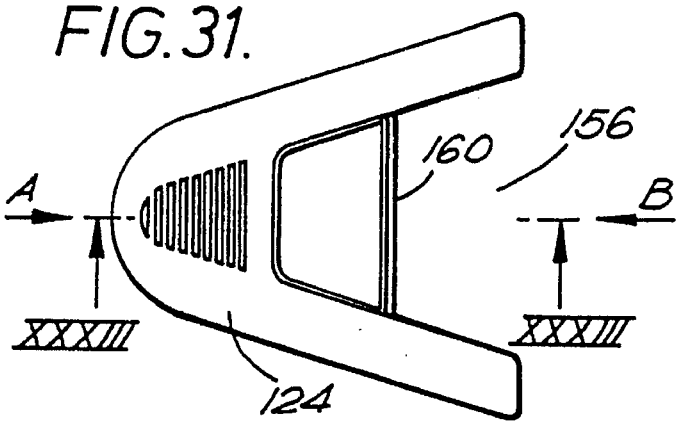
FIG. 32.
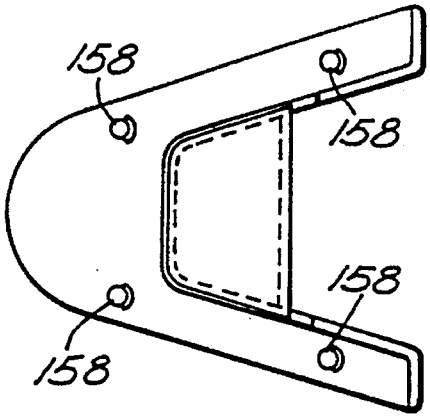
FIG. 33.
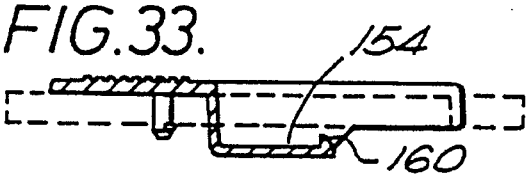
FIG. 34.
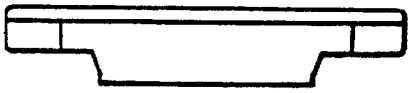
FIG. 35.
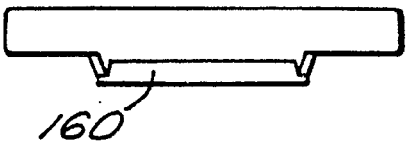
FIG. 36.
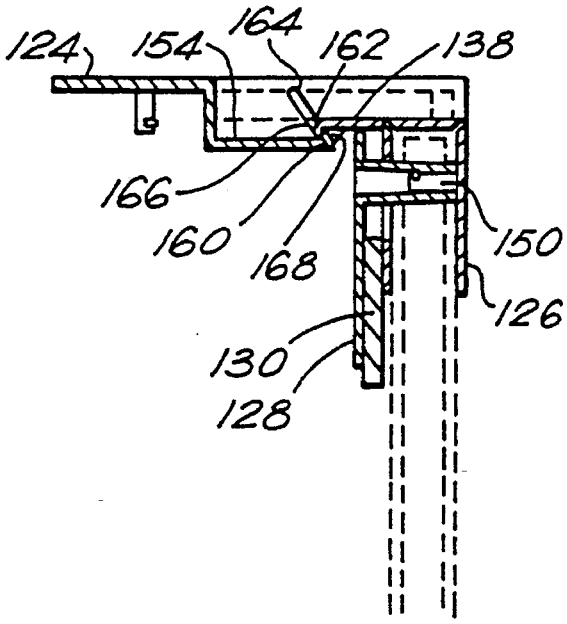
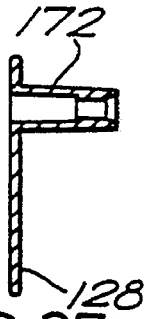
FIG. 37.
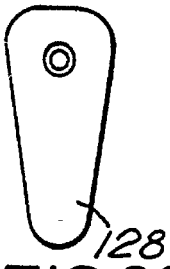
FIG. 38.

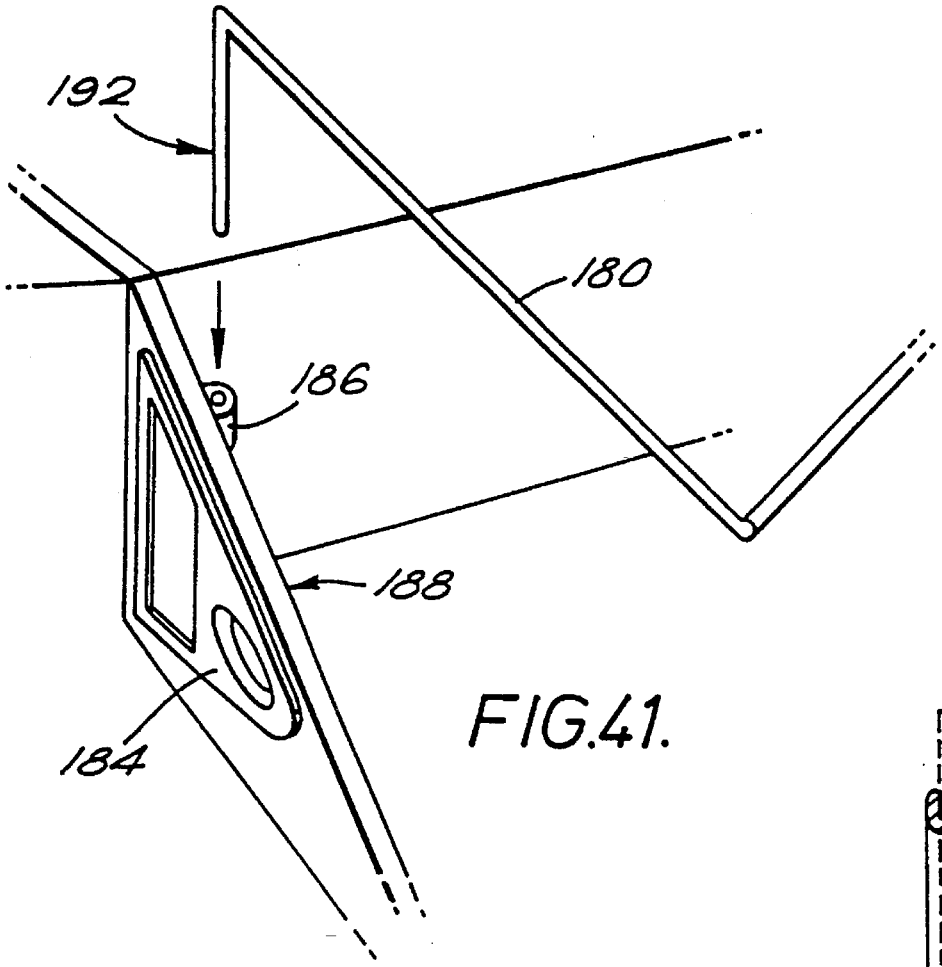
FIG.41.
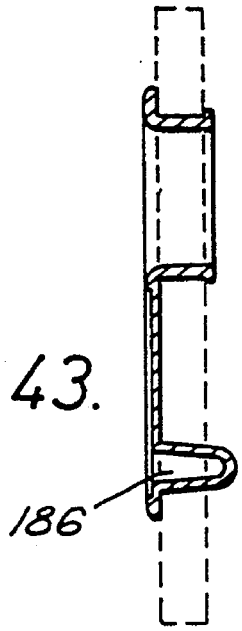
FIG.43.
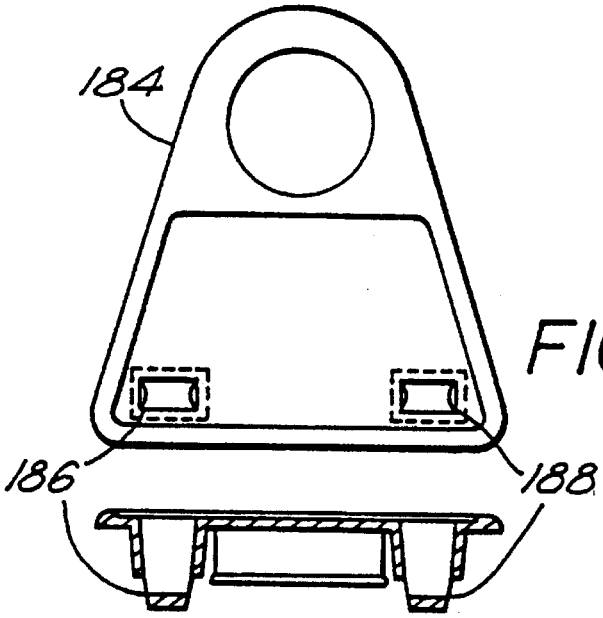
FIG.42.
FIG.44.
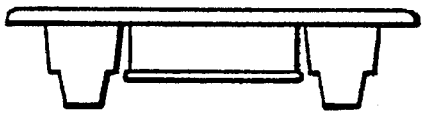

FIG.45(a).
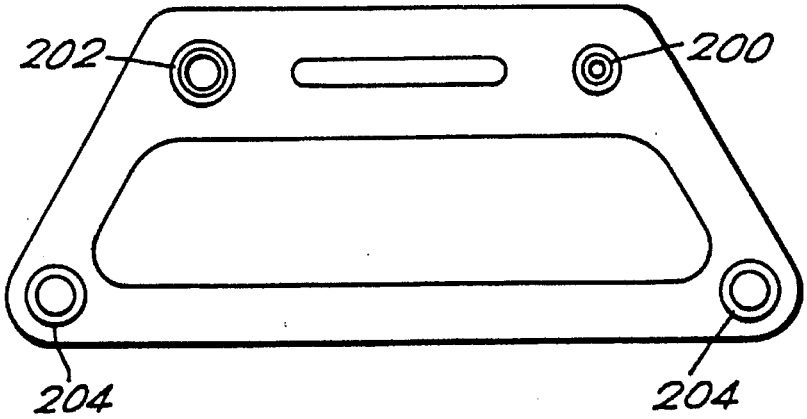
FIG.45(b).
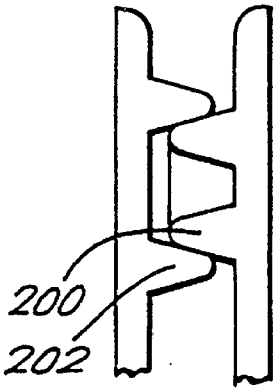
FIG.46(a).
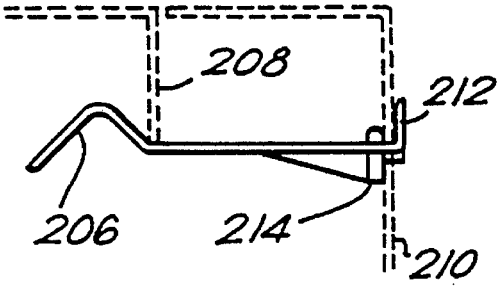
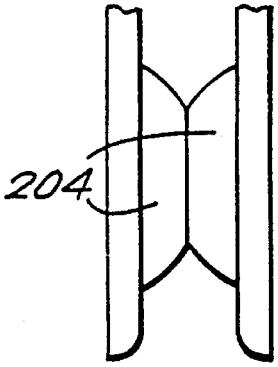
FIG.45(c).
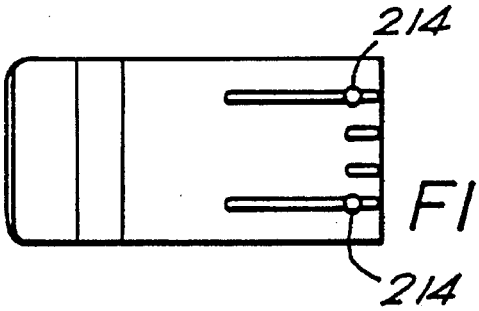
FIG.46(b).
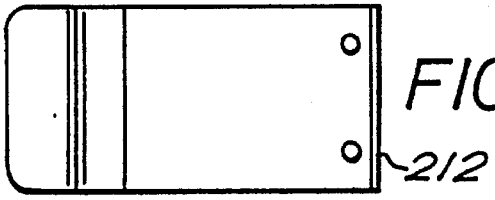
FIG.46(c).

MODULAR FILING & STORAGE SYSTEM

This invention relates to filing and storage systems, such as box files and index card boxes and particularly to systems of this kind which are designed to facilitate "self assembly".

It is particularly, although not exclusively, concerned with filing and storage systems of the kind disclosed in our prior International Patent Application, Publication Nos. 90/05643 and 92/00857. These applications are concerned with filing and storage systems which provide various configurations of files and file boxes, and the present invention seeks to provide further improved configurations of articles of this kind.

According to a first aspect of the invention there is provided a blank for constructing a box file, card index box, or the like which, in the made up form, comprises a pair of similar half shells hinged together along a common edge, the blank including a pair of base members each having outwardly extending side portions on at least three sides which can be bent up to form side walls, with the said side portions on each pair of adjacent sides being joined by an inwardly foldable connection section which is adapted to form a closed corner when the blank is folded into shape.

Preferably the two half shells are "mirror images" of one another and each has a pair of opposite end walls which are triangular so that the closed box exhibits a "diagonal cut" line across each end where the triangular walls meet. This construction has the particular advantage, in use, that papers can be retained in either half of the box when it is open, and are not likely to fall out because each half shell has retaining walls around three sides.

The term "half-shells" is used herein to describe the two halves of a box structure which when suitably positioned next to one another, form an enclosed box. Where these are described as being "mirror-images", this implies that they are (for example) identical shapes, or complementary shapes which are reversed right-to-left, so that they can in any case fit together to form a complete box. In cases where the complementary half shells have one wall on each side which is triangular, the resulting box structure will therefore exhibit corresponding sides which are diagonally divided from one corner to an opposite corner, this appearance being referred to herein as a "diagonal cut" line.

Preferably, the blank is so shaped that the inwardly folded section at each corner is retained in position by folding over it, a further outwardly extending flap portion on one of the adjacent sides.

A preferred form of the invention provides a blank for constructing a box file, which, in the made up form, comprises a pair of similar "half shells" hinged together along a common edge, each half shell comprising a tray like member having a base with an upstanding side wall extending along one edge, and two opposed end walls in the form of right angle triangles, the two half shells being hinged together along a line which defines the top edge of the upstanding side wall of one half shell, and the edge of the base which is opposite the upstanding side wall, of the other half shell, so that when closed, the end walls of the box show a diagonally extending line at the junction of the two half shells; the blank comprising:

(a) a first rectangular portion forming the base of one half shell;

(b) a first pair of "double-triangular" flaps, one extending from each end of the first rectangular portion, and each being so shaped as to be foldable to form one of the said triangular end walls;

(c) a second rectangular portion, connected by a common edge to a third side of the first rectangular portion, and being narrower than the said first portion so as to form one upstanding side wall;

(d) a second pair of "double triangular" flaps connected to opposite sides of the second rectangular portion, and each of which has one side in common and connected to one corresponding side of the adjacent first "double triangular" flap;

(e) a third rectangular portion of the same size as the first rectangular portion, and adapted to form the base of the other half shell and thus the opposite side of the box; and (f) a third pair of "double triangular" flaps extending from opposite sides of the said third rectangular portion and each being so shaped as to be foldable to form one of the said triangular end walls;

(g) a fourth rectangular portion, adapted to form the opposite side to the said second rectangular portion; and (h) a fourth pair of "double triangular" flaps, each of which is arranged at one end of the said fourth rectangular portion, and is connected by one of its other edges to the adjacent edge of the corresponding third "double triangular" flap.

The expression "double triangular" flap herein is used to mean an inwardly foldable section comprising two triangular parts which are conjoined by a common side, and which are "mirror images" of one another, so that when the flap is folded along the common side, the two triangles overlap. By this means, it is possible to form particularly rigid triangular end walls on a box of the type described, and in addition, the incorporation of the smaller "double triangular" flaps joining one side of each triangular end wall, to the corresponding side of the upstanding side wall of the respective half shell, enables the corners of the box to be very neatly finished, by virtue of the cooperation of the inwardly folded small "double triangular" flap, with its adjacent large "double triangular" flap.

Preferably, in addition to the first to fourth rectangular portions which in use form the main rectangular walls of the box, there are also provided a fifth large rectangular portion, attached to the "free" edge of the first large rectangular portion, and adapted to be folded over onto it, so as to finish and hold in position the sides of the first half shell, and a sixth, small rectangular portion, corresponding in size to, and connected to the free edge of, the said fourth rectangular portion, so as to correspondingly finish and hold in position the end wall and the triangular side walls of the second half shell.

Alternatively the fifth large rectangular portion may be made with additional fold lines which enable it to be folded into a flattened box section to reinforce the free edge of the first large rectangular portion. This is particularly useful where a clip or catch is to be mounted on this edge.

According to a second aspect of the invention, there is provided a file storage or archive box having a generally rectangular body, one side of which comprises an opening for access to the interior of the box and is sloped relative to the opposite side; an inner sleeve or liner which fits around the interior of the box, so as to leave an opening corresponding to the opening of the box, and a cooperating lid assembly comprising a lid having cooperating side edge walls with a slope formation that complements the formation of the open side of the box, and a flap for retaining the lid in position, which is adapted to slide between the outer surface of one side of the sleeve and the inner surface of the adjacent side of the box.

Alternatively or additionally, the interior of the box may be fitted with various configurations of horizontal shelves and/or vertical partitions, and in a preferred form of the invention, the box is reinforced by means of at least one partition which extends across the interior from one side to another, and which comprises a double layer of card.

Preferably, the box is provided with catch means for retaining the lid in the closed condition, and according to a further aspect of the invention there is provided a catch member for the lid of a box or container in which the interior of the container is divided by a double walled partition that extends across the interior of the box and to the plane of the opening, a small gap being allowed between the front edge of the partition and the adjacent wall of the box; the catch member comprising a flat body portion adapted to slide into the gap, and carrying a tapered detent member which is adapted to engage in the space between the double walls of the partition, so as to prevent the catch from subsequently being pulled out.

According to a further aspect of the invention, there is provided a catch member for the lid of a box or container comprising an elongate body adapted to project from the inner surface of an internal wall member of the lid. adjacent to one edge and having a tongue portion at its outer end which is adapted to engage behind a flange or lintel portion of a cooperating edge of the box; the catch being connected to the wall member by means of projections which extend from opposite sides of its inner end, and are adapted to lock the catch into a slot in the wall.

Preferably, the said inner end is formed with a right-angled flange which forms one of the said projections on one side of the inner end, and one or more oppositely projecting studs or detents on the other side which are offset from the end, so-that in use, the flange is passed through the said slot to engage the other side of the said wall member while the said studs or detents engage the said inner surface of the wall member.

The box may also be provided with a reinforcing section such as an extra "flat-box" bulkhead or lintel section along one edge and the catch may be adapted to fit behind the bulkhead or into a suitably formed aperture in the bulkhead, which helps to ensure that the box does not deform or bow around the clip.

Preferably, the body of the catch and/or the detent member are also so shaped as to inhibit sideways movement of the catch body, relative to the partition or lid into which it is fitted.

The invention also extends to an interconnecting or stacking system for forming vertically and/or horizontally extending arrays of boxes such as file boxes, and comprising a plurality of connector members each comprising a body having a slot or aperture and adapted to be mounted on the wall of the box and a generally "U-section" clip me having a pair of legs each of which is adapted to fit in one of the said slots, whereby, when two such connector members are suitably positioned in the adjacent walls of two corresponding boxes, they may be clipped together by inserting the legs of the clip member into the adjacent slots.

Preferably, two types of connector member are provided, one of which is adapted to be positioned near the base of a side wall and carries a single slot or aperture, and the other of which is adapted to be positioned near the top edge of a side wall and carries a pair of slots or apertures, arranged one above the other, so that the upper slot may be used to connect the box to a "single slot" connector in the side wall of a box above it, whilst the lower slot may be used to connect the box to the lower slot of another "double-slot" connector in a corresponding position in the side wall of an adjacent box, by means of a "bridging" clip.

Preferably, the lower slot is enlarged so as to facilitate the insertion of the clip in a lateral direction and also to allow the slot to be used as a handle for the box.

In addition the-outer-surface-of each "connector" member may be provided with interengaging formations which are adapted to co-operate with mating formations on the outer surface of a connector member of an adjacent box, so as to assist in maintaining them in their required side-by-side relationship. Preferably, the formations are of "male and female" types and are arranged in pairs with a male and a female member on left and right sides, (for example), of the surface of the same connector member, so that they can co-operate with respective female and male members arranged in the same positional relationship on the outer surface of a facing connector member.

According to a further feature of the invention there is provided a closure catch particularly adapted for use with a box file, of the kind in which the walls comprise double layers of rigid material such as corrugated cardboard, the clip comprising a first body part of moulded plastics material, adapted to fit around, or in a recess of the edge of one wall of the box, and carrying a protrusion which extends in the direction of the adjacent wall to which it is to be clipped to close the box; and a second body member, adapted to fit in a recess or cut-out in the said adjacent edge, and forming a detent member which is adapted to receive the catch part of the first member.

A closure clip or catch member formed in this way is particularly useful for file boxes adapted to receive concertina files, for example as shown in our above International Patent Application Publication No. 90/05643, mentioned above, because the first body part of the catch member may also be provided with dependent retaining means, to engage and retain the upper edge of the rear wall of the concertina file, in position against the corresponding wall of the filing box. Preferably, the retaining means is formed as a swivelling clip which is rotatably mounted on the internal surface of the body of the first member of the catch, so that it can be swung clear of the rear wall of the concertina file, when it is to be inserted into, or removed from, the box file.

According to a further feature of the invention there is provided a box file of generally book like construction, comprising a rear half which forms a base when the box is open, connected to a front half which forms a cover, by means of a flat "spine" member; and having an internal document retaining arm which is mounted so as to be pivotable about an axis which is adjacent to and parallel with a shorter edge of the spine, and has an outwardly extending arm portion which swings from an engaged position in which it extends over the central area of the base, to retain documents, to a released position in which it lies adjacent to and parallel with, one edge of the rear half.

Preferably, the outer end of the arm portion terminates in a right angled portion which is arranged to lie flat on the documents in the engaged position.

Preferably the retaining arm is made from a relatively resilient wire material which is bent at a right angle in one plane, at one end, to form a pivot arm, and is also bent at a right angle in a substantially perpendicular plane at the other end to engage against the surface of the documents.

Preferably the pivot section is mounted in an arm retaining member which forms a socket for the pivot and which is fitted into a shaped aperture in the end wall of the box adjacent the spine, or in the base of the spine itself.

Some embodiments of the invention will now be described, by way of example, with reference to the accompanying drawings in which:

FIG. 9 is a plan view of a lid catch for the type of box shown in FIGS. 7 and 8;

FIG. 10 is an underneath plan view of the catch of FIG. 9;

FIG. 11 is a side edge view of the catch of FIGS. 9 and 10;

FIG. 12 is a schematic edge view, corresponding to the view of FIG. 11, with the catch installed in its operating condition;

FIG. 13 is an elevational view of a first connector member of a box stacking system in accordance with the invention;

FIG. 14 is a rear elevation view of the connector member of FIG. 13;

FIG. 15 is a vertical cross section through the connector member of FIG. 13;

FIG. 16, is a front elevational view of a second type of connector member;

FIG. 17 is a rear elevational view of the connector member of FIG. 16;

Figure 7:
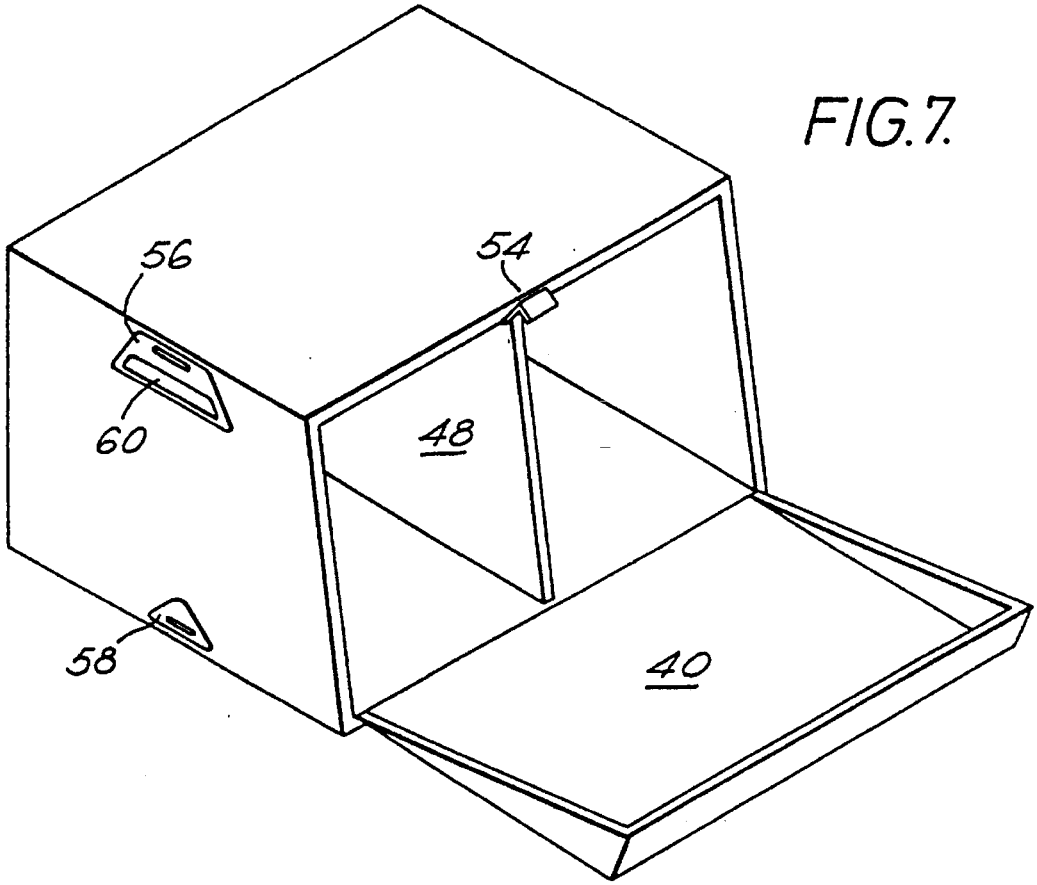
FIG. 7 is a perspective view of a first type of archive box based on the construction of FIGS. 5 and 6.
Figure 8:
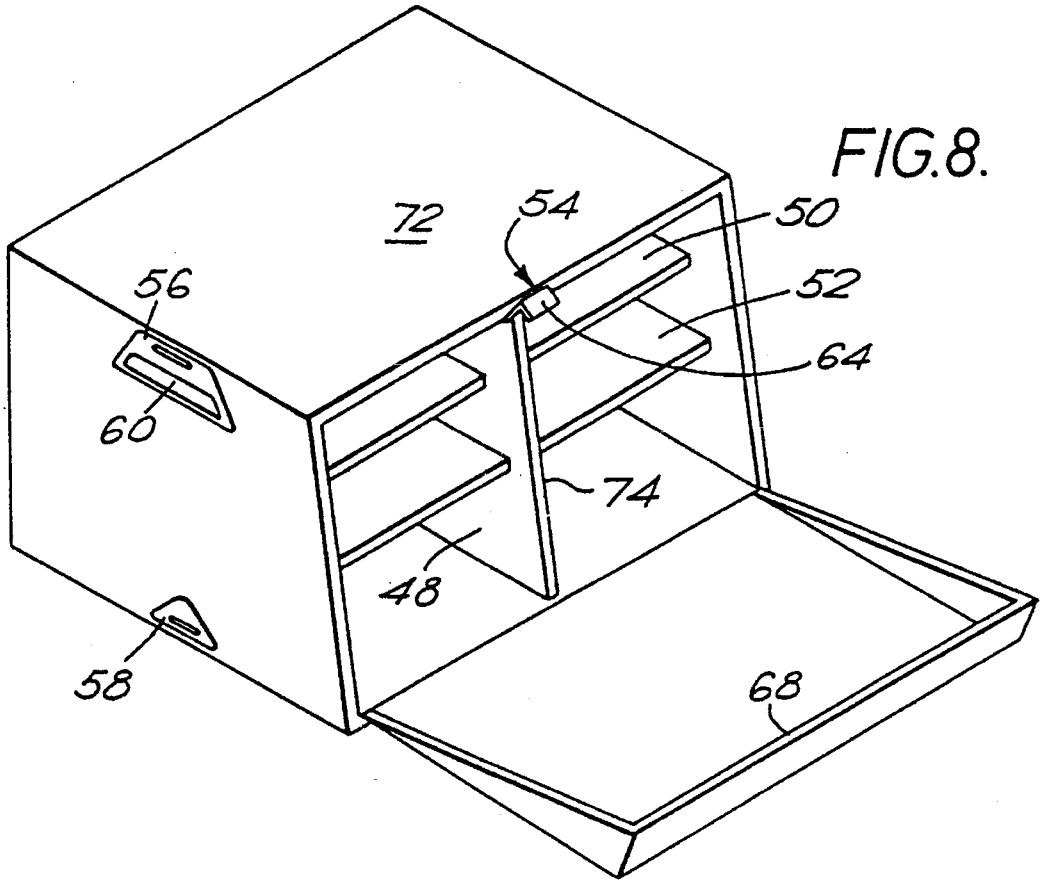
FIG. 8 is a perspective view of a second type of archive box.
Figure 24:
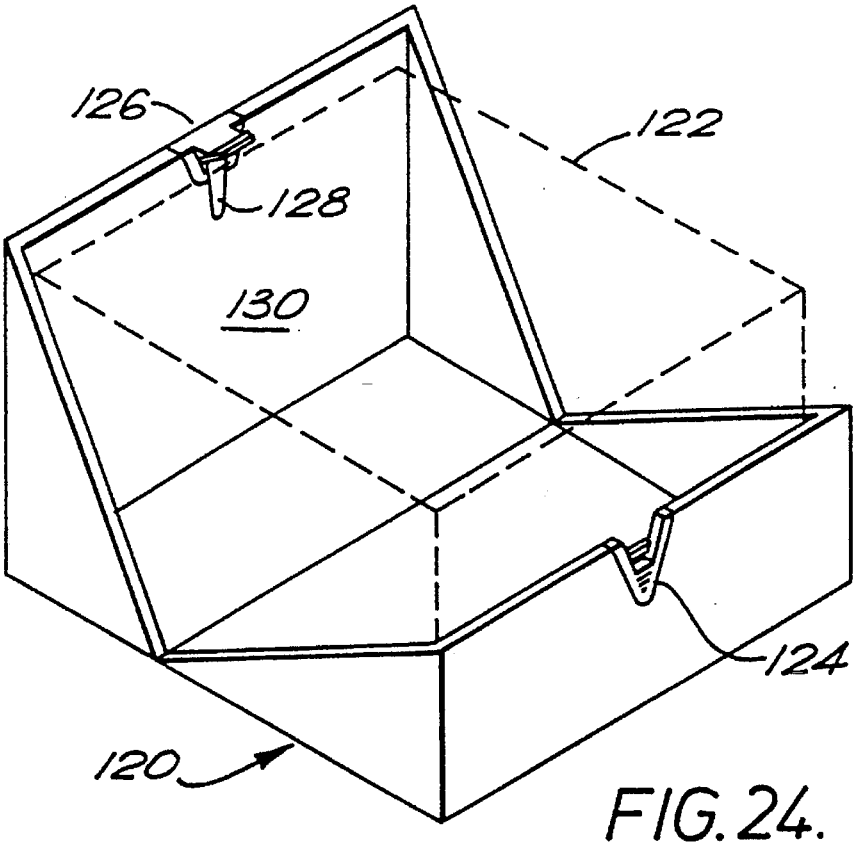
Figure 25:
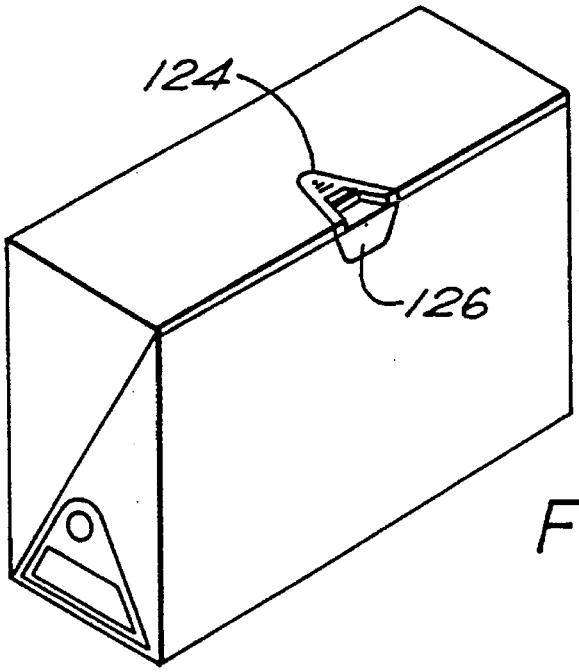
Figure 39:
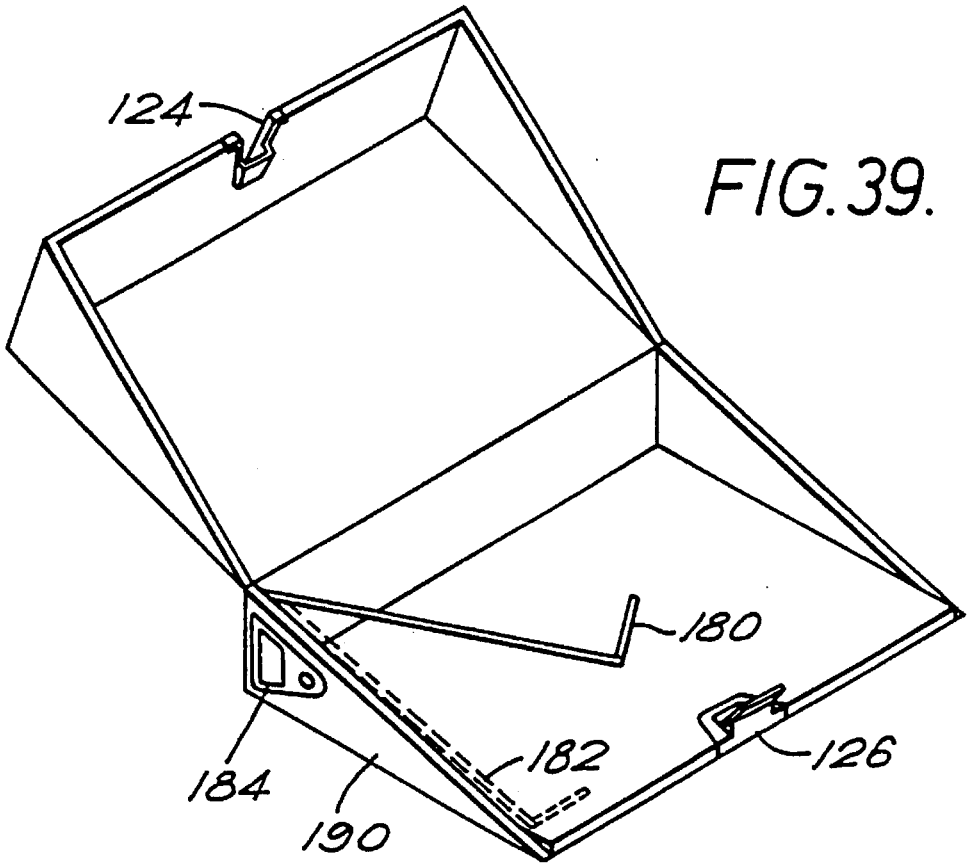
Figure 40:
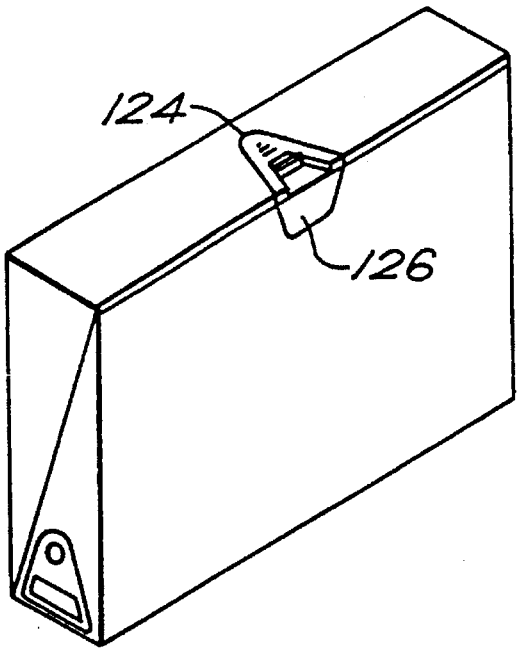

FIG. 18 a vertical cross-section through the connector member of FIG. 16;

FIG. 19 is a front elevational view of a stacking clip for use with the connector members of FIGS. 13 to 18;

FIG. 20 is a rear elevational view of the clip of FIG. 19;

FIG. 21 is a vertical cross section through the clip of FIG. 19;

FIG. 22 is a side elevational view of a part of a stacked array of boxes, showing the clip system of FIGS. 13 to 21, in use;

FIG. 23 is a diagrammatic cross-section, illustrating how the stacked box array is connected together;

FIG. 24 is a perspective view of an open box file suitable for receiving a concertina file;

FIG. 25 is a perspective view of the box file of FIG. 24 in the closed condition;

FIG. 26 is a top plan view of a first part of a closure clip particularly adapted for use with the box file of FIGS. 24 and 25;

FIG. 27 is an underneath plan view of the clip of FIG. 26;

FIG. 28 is a cross-section through the line XXVIII—XXVIII of FIG. 26;

FIG. 29 is a cross-section XXIX—XXIX of FIG. 26;

FIG. 30 is a cross-section through the catch of FIG. 26, in a "made-up" condition;

FIG. 31 is a top plan view of a second part of a box catch, adapted to cooperate with the part shown in FIGS. 26 to 30;

FIG. 32 is an underneath plan view of the catch of FIG. 31;

FIG. 33 is a vertical cross-section taken along the line XXXIII—XXXIII of FIG. 31;

FIG. 34 is an end view of the catch of FIG. 31 as viewed on the arrow A;

FIG. 35 is an end view taken from the other end, on the arrow B;

FIG. 36 is a vertical cross-section through a closed catch assembly comprising the two parts illustrated in FIGS. 26 to 35;

FIG. 37 is a vertical cross-section through a retaining clip forming part of the assembly of FIG. 36;

FIG. 38 is a front view of the clip of FIG. 37;

FIG. 39 is a perspective view of a file box incorporating a document retaining arm in accordance with the invention, the box being in an open condition;

FIG. 40 is a perspective view of the box of FIG. 39 in a closed condition;

FIG. 41 is an enlarged view of part of the box of FIG. 39;

FIG. 42 is a front elevation view of an arm retaining member for the box of FIG. 39 and 40;

FIG. 43 is a vertical cross-section through the arm retaining member of FIG. 42;

FIG. 44 is an underneath plan view of the arm retaining member of FIG. 42;

FIGS. 45 (*a*), (*b*) and (*c*) show a modified version of the socket member of FIGS. 16 to 18 and FIGS. 46 (*a*), (*b*) and (*c*) show an alternative for of lid catch for the box of FIGS. 7 and 8.

Referring firstly to the file box construction of FIGS. 1 to 4, FIG. 1 shows a blank which is adapted to be folded to form a file box, the arrangement being such that the folded construction is inherently self supporting. The blank comprises a first rectangular portion 2, corresponding to the largest profile of the assembled box, each end of which carries a "double triangular" flap 4 or 6. The "double triangular" flap comprises a first triangular section 8 or 10, forming a right angle triangle, and a second section 12 or 14 which is a further triangular portion, forming a "mirror image" of the first section, and is connected to it by the hypotenuse, along which a fold line will be formed, when the box is assembled.

A second rectangular section 16 is connected along one long edge to the first section 2, to form the "spine" of the completed file box, and also has a "double triangular" flap formation 18, 20, at each end. Each of these "double triangular" flaps connects one of the short ends of the part 16, with the adjacent short end of the corresponding right angle triangle 8 or 10, so that, when the box is assembled, these small flaps 18 and 20 fold inwardly of the box (see for example, FIG. 3).

A second portion 2*a*, to form the opposite side of the box to the portion 2, is connected by one of its longest edges to the narrow section 16, and has large "double triangular" flaps 4*a* and 6*a* at each end, corresponding in arrangement to the flaps 4 and 6 of the first section 2. A further narrow section 16*a* has small "double triangular" flaps at each end, corresponding to the smaller "double triangular" flaps of the section 16, and the blank is completed by a further narrow section 22 at one end, connected by its long edge to the section 16*a*, and a further large profile section 24, corresponding in size to the section 2, at the other end, and connected to it by a common edge 26.

Figure 1:
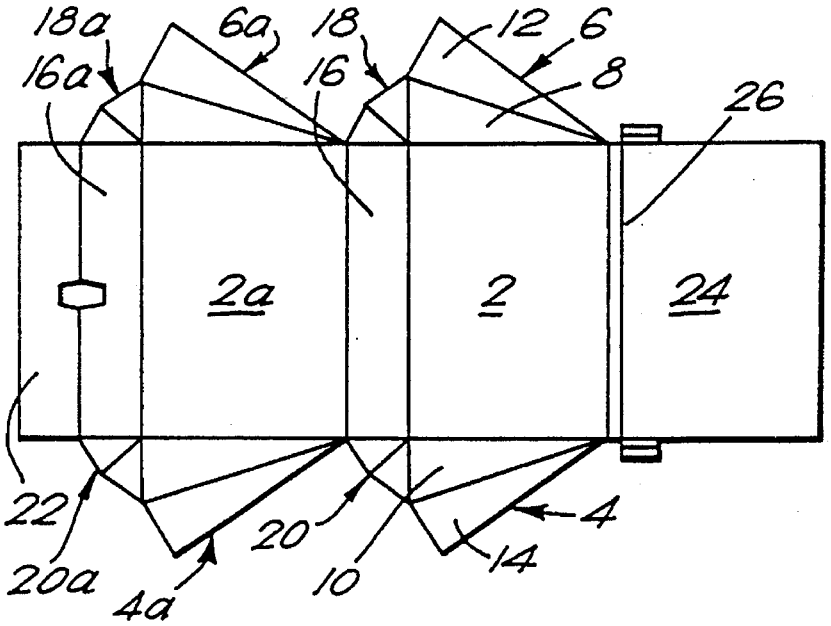
FIG. 1 is a plan view of a blank for constructing a box file.
Figure 2:
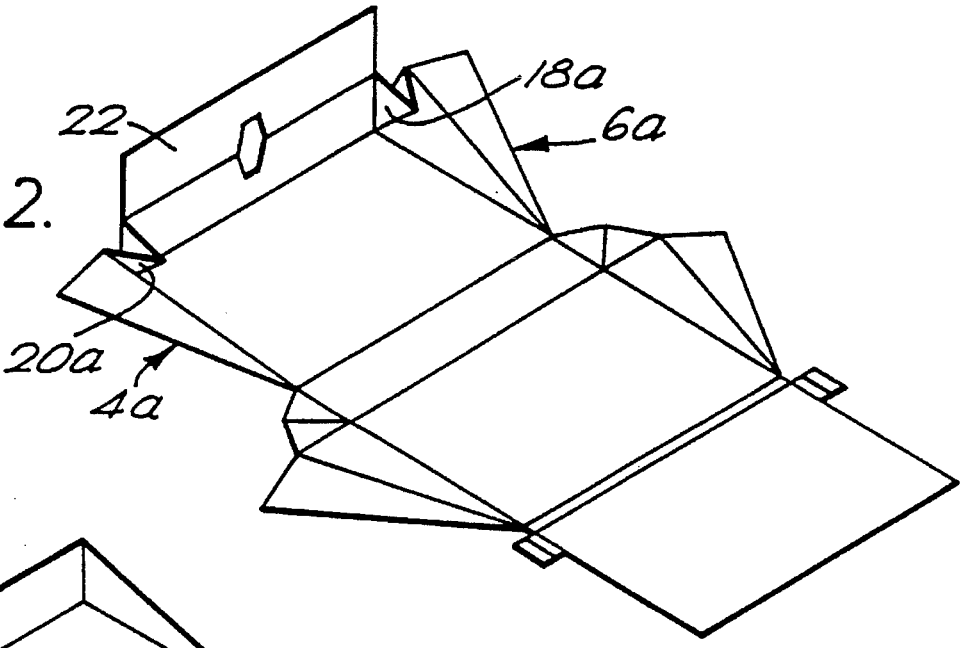
FIG. 2 is a perspective view of the blank of FIG. 1, in a first, partially folded condition.

As can be seen from FIG. 2, the box is assembled by first folding inwardly, the small triangular flaps 18*a* and 20*a*, and then folding the outer triangles of the large triangular flaps 4*a* and 6*a* inwardly over these. The extreme outer edge flap 22 is then folded inwardly to the position shown in FIG. 3, so as to form a first completed "tray section", 28 comprising the "lid" of the completed file box.

Figure 3:
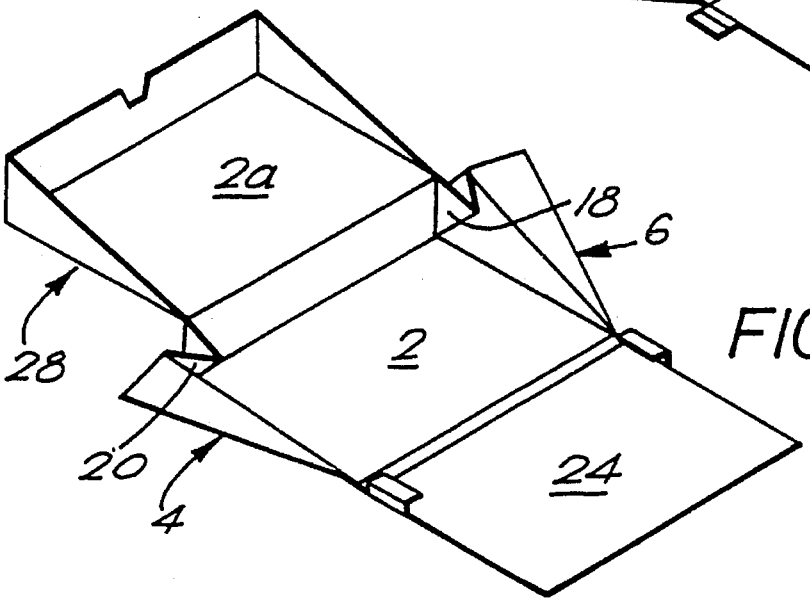
FIG. 3 is a perspective view showing the blank of FIG. 1 in a further, more folded condition.

The small "double triangular" flaps 18 and 20 are then folded inwardly, also as indicated in FIG. 3, and finally the outer triangular portions 12 and 14 of the large "double triangular flaps" 4 and 6 are folded inwardly over these, to form the end walls of the "base" section of the file box. The box.is completed by folding the large end flap 24 inwardly, so as to be superimposed over the base 2, resulting in the completed file box of FIG. 4.

Figure 5:
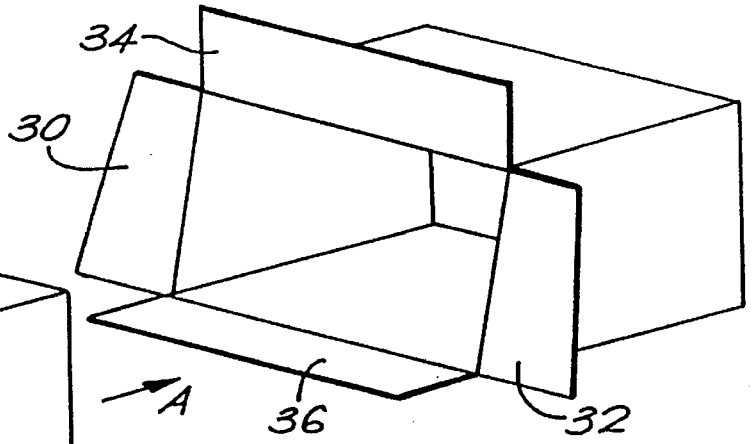
FIG. 5 shows a partly disassembled view of an "archive storage" file box.
Figure 6:
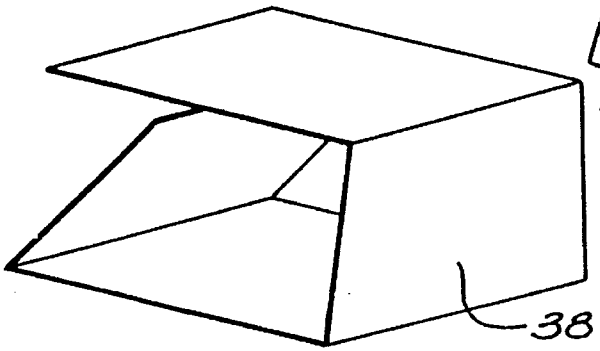
FIG. 6 shows the box of FIG. 5 in a further stage of assembly.
Figure 6:
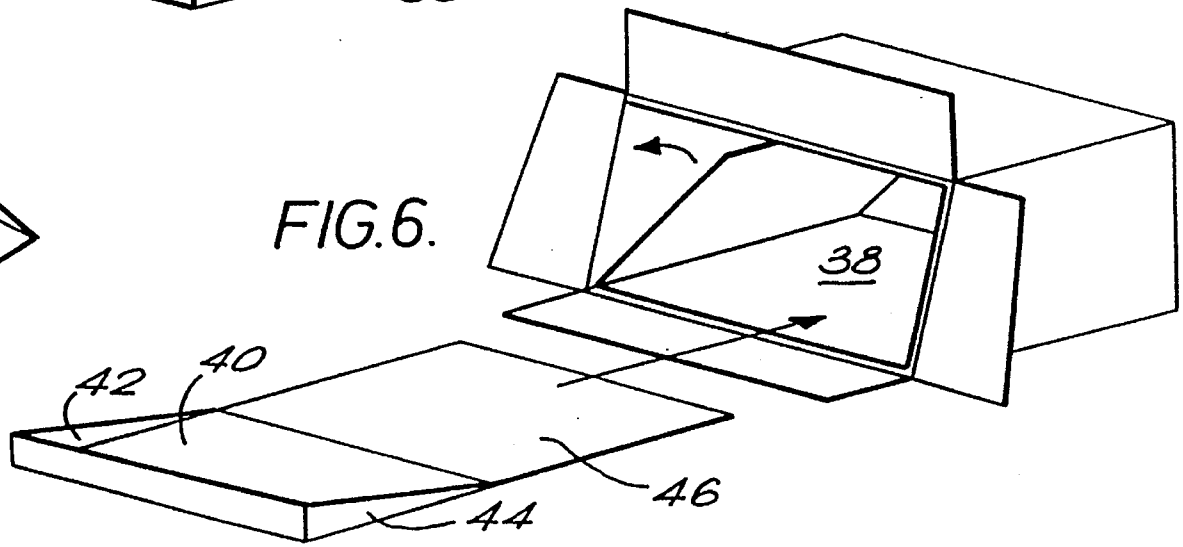
Figure 4:
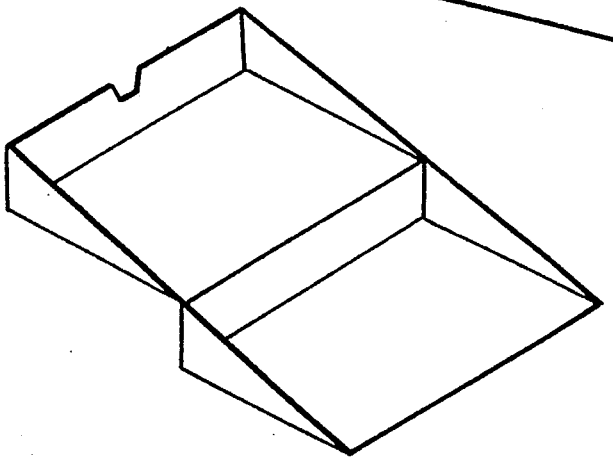
FIG. 4 shows the assembled box file, in an open condition.

A second type of file box is illustrated in FIGS. 5 and 6, and comprises a conventional type of outer shell having an opening with side flaps 30, 32 and top and bottom flaps 34 and 36, and an inner liner 38 which is inserted in the direction of the arrow A, FIG. 5, to the internal position indicated in FIG. 6.

The box is of the general kind described in our above mentioned patent application publication no. having a sloping aperture, and a co-operating lid 40, having complementary triangular end walls 40 and 42, is adapted to be fitted to the box by means of a flap 46 which slides between one side of the liner, and the corresponding internal wall of the box.

As illustrated in FIGS. 7 and 8, the interior of the box may be divided up by a central, vertically extending partition 48, and further horizontally extending dividing shelves 50, 52, whose central region is supported by the vertical partition 48, if required. A catch member 54 for retaining the box in the closed position, is located in position at the top of the front edge of the internal partition 48, as described in more detail below with reference to FIGS. 9 to 12.

The box also incorporates stacking connectors 56, 58, respectively located near the top and bottom edge of each side wall, which are also described in more detail below with reference to FIGS. 13 to 23. As can be seen from the figures, the upper stacking connector 56 incorporates a large aperture 60 which can be used as a handle, when the box is to be moved around manually.

The construction of the closure clip 54 is illustrated in more detail, in FIGS. 9 to 12, and comprises a generally flat body 62, having an upwardly projecting tongue portion 64 at one end. The central region of the catch carries a U-shaped cut-out 66 which allows the tongue portion 64 to flex downwardly, to the dashed line position indicated in FIG. 12, when the edge 68 of the box lid is closed over it.

A tapered detent member 70 is formed on the undersurface of the catch, as indicated in FIG. 11, and in use, the body of the catch is slid into a small gap which is left between the top edge of the partition 48, and the underside of the top wall 72, to occupy the position indicated in FIGS. 7 and 8. The partition 48 is formed from a folded sheet, with the fold running along the front edge 74, so that the partition has a U-shaped cross-section as indicated by the dashed-lines 76 in FIG. 10, and thus, when the catch member is inserted to its fullest extent, the tapered retaining member 70 fits inside the cross-section, and a further dependent projection 78 engages with the front vertical surface 74 of the cross-section, so that the catch is then securely located in position. Further downwardly dependent "fins" 80 and 82, at the-trailing edge of the catch body, extend downwardly at positions on either side of the partition section, so as to stop the catch from moving sideways.

Parts of the box stacking system are illustrated in more detail, in FIGS. 13 to 23. FIG. 13 shows a small stacking connector, adapted to be positioned at the lower edge of each side of a box as illustrated in FIG. 7, which comprises a flat generally triangular body, incorporating a slot 90 which is flanged as illustrated at 92 in FIG. 15, so as to provide a guide for the leg of a stacking clip. Three posts 94, extending rearwardly from the body of the socket member, carry arcuate flanges 96 which are adapted to engage in the corrugated material of the side wall of the box, so as to hold the connector member in position.

FIG. 16 shows a front view of a second connector member of the kind illustrated at 56 in FIG. 7, which has a larger body than the connector member 58, and is adapted to be positioned at the upper edge of the side wall of the box, as shown in FIG. 7. A large aperture 60 in the body of the connector member, forms a handle for the side of the box, and is deeply flanged as indicated at 98 in FIG. 18, so that the flange will extend right through the material of the side wall of the box, to form a stable hand grip. The top and bottom edges of the flange carry a further right angled protrusion, 100, to engage the edge of the internal surface of the box, and thus hold the connector member in position.

A smaller slot 102 for receiving the leg of a stacking clip, is formed in the upper part of the body of the connector member, so that, in use, when boxes are stacked one on top of the other, the small connector member 58 of the upper box will be positioned as indicated by the dashed lines in FIG. 16, relative to the large connector member 56, of the lower box. The two slots 90 and 102 are therefore brought into juxtaposition, so that a suitably U-shaped clip member can be inserted in the adjacent slots.

As shown in FIGS. 19 to 21, the clip member 104 comprises a channel section, having legs 106 at each side, each of which is adapted to engage in one of the slots 90, 102 of the adjacent socket members. The assembled arrangement is thus illustrated more clearly in FIG. 22, where the engaged position of the clip is illustrated by the dashed lines 108.

A vertical cross section through the adjacent edges of the two stacked boxes, showing how the clip 104 is inserted, is illustrated in FIG. 23. In the inserted position, the legs 106 of the clip pass through the adjacent small slots 90, 102 of the connector members 58, 56, so as to hold the base 110 of the upper box, firmly in engagement with the top surface 112 of the lower box. As will be seen from the lower part of the figure, it is also possible to connect the lower box in a side-to-side relationship with another, corresponding box, by means of a further clip 114 which is inserted in a horizontal orientation, with its leg 116 straddling the base of the large, handle forming socket 60, so that the other leg 118 extends outwardly to a position in which it can be correspondingly engaged with the socket 60 of another connector member 56 on an adjacent box. In this way, a large array of inter-connected boxes, extending both horizontally and vertically, can be built up.

FIG. 24 illustrates a file box 120, folded from a blank of the kind described above with reference to FIGS. 1 to 4, which is particularly adapted to hold a concertina file in the position indicated by the dashed outline 122, when the concertina file is extended, in the general manner described in our above mentioned International patent application published under no. 90/05643. The box is provided with a catch comprising two parts 124, 126, which latch together to the closed position indicated in FIG. 25, and part 126 incorporates an internal dependent retaining member 128, to fit over the top edge of the rear wall 130 of the concertina file, to hold it in position in the box.

FIGS. 26 to 30 illustrate the main body of the catch part 126 in more detail. This is formed as an initially planar, injection moulded component, having a generally hexagonal outline, with two laterally extending depressions 132, 134, forming hinge regions which enable the body to be folded into a U-shaped condition, so as to embrace the edge of a box wall, as illustrated in FIG. 30. A cut-out 136, whose profile corresponds generally to the outline of the corresponding side of the catch, forms a tongue 138 which remains coplanar with the central portion 140 of the body of the catch, when the remainder is folded over.

Cross-sections through the catch body, before it is folded over, are illustrated at two different axial regions, in FIGS.

28 and 29. FIG. 28 is a cross-section taken through the off-axis line XXVIII—XXVIII of FIG. 26, whilst FIG. 29 is an axial cross-section. As can be seen from the drawings, and particularly FIG. 27, the underside of the catch body is provided with a pair of protruding posts 142, 144, and corresponding sockets 146, 148, which are brought into engagement, as illustrated in FIG. 30, when the body is folded into the position in which it engages on the edge of the side wall of the filing box. It will be appreciated that corresponding apertures are formed at positions corresponding to the positions of socket 146, 148, in the side wall of the box, so as to receive the socket members and thus hold the catch in position.

A further post 150, positioned on the centreline of the catch body, and closer to the hinge region 132 than the other two posts 142, 144, is so arranged, that when the catch is in the mounted position on the edge wall of the box, it faces the aperture 152 left on the inner surface of the catch after folding the body, by the material forming the tongue 138. This post 150 is used to locate a concertina file retaining clip, as described in more detail below, with reference to FIGS. 36 to 38.

FIGS. 31 to 35 illustrate the other, cooperating part 124 of the catch, which comprises a generally "V-shaped" body, having a centrally recessed portion 154 which is adapted to fit into a suitably shaped cut-out wall edge, corresponding generally to the "inner V" shape of the catch body, so as to leave an opening 156 into which the tongue 138 of the catch member 126 will extend in use, as explained in more detail below. Once again, the catch body is provided with suitable posts 158, to engage in apertures adjacent the edges of the cut-out of the box, so as to hold it in position.

As illustrated in FIGS. 31 and 35, the latter being an axial view on the arrow B of FIG. 31, the edge of the recess portion 154 is formed with an upstanding lip or flange 160, and in use, as illustrated in FIG. 36, this co-operates with a mating downturned flange 162 on the tongue 138 of the other part 126 of the catch, to hold it in a closed position. The edge of the tongue 138 also carries an upstanding flange 164 which can be engaged by the finger or thumb of an operator, so as to release the catch. It will be appreciated that in use, as a result of the complementary sloped formations 166, 168, on the faces of the mating edges 162 and 160, the catch will automatically "snap" into the closed position, when the two wall edges are brought together.

As mentioned above particularly with reference to FIG. 30, the inwardly facing post 150 on the body of the catch part 126 is adapted to receive a downwardly dependent retaining member 128, illustrated separately in FIGS. 37 and 38, having a socket member 172 which snaps pivotably onto the post 150, so that the upper edge of the rear wall 130 of a concertina file can be held in position, as described above with reference to FIG. 24. Because the socket member 172 is pivotable on the post 150, the retaining member 128 can be swivelled out of engagement with the concertina file wall, when it is to be inserted or removed.

As illustrated in FIGS. 39 and 40, the blank of FIGS. 1 to 4 can also be used to make up a document file box, also incorporating a catch of the kind described above with reference to FIGS. 27–35. The interior of the box carries a pivotable document retaining arm which is shown in its document retaining position 180 in a full outline, and in a retracted position in which papers can be inserted or removed, by the dashed outline 182. The arrangement for locating the arm in position is illustrated in more detail in FIGS. 41 to 44. A generally triangular mounting member 184 is fitted into a co-operating recess at the base of one of the triangular end wall portions 190 of the file box, and carries a pair of inwardly protruding projections 186, 188, which form an axially aligned hinge socket. As illustrated in FIG. 41, the document retaining clip itself comprises a fairly rigid piece of wire having a bent end portion 192 which fits pivotably into the socket members 186, 188.

FIG. 45(*a*) is an elevational view of a modified form of the connector member 56 of FIGS. 16 and 17, in which there are additional "stud and socket" members 200, 202 on the outer face of the connector member. As shown these are located at the opposite ends of the upper face of the connector. As illustrated in the enlarged view of FIG. 45(*b*), this enables the facing studs and sockets 200, 202 of two facing connector members, located on the facing walls of side-by-side boxes, to interengage with one another so as to assist in locking an array of stacked boxes in their proper positions. As illustrated further stud members 204 may also be arranged on the lower part of the face of the connector, both of these being of the same size so that they abut against corresponding studs on the facing connector as shown in FIG. 45(*c*) to maintain a constant spacing between them. This also helps to lock the assembly in position when the two connectors are bridged by a clip 114 as described above with reference to FIG. 23.

FIG. 46(*a*) shows an alternative form of lid closure catch to that of FIGS. 9 to 12, which is adapted to be mounted on the inside of the box lid rather than on the edge of the box. As shown, this has a tongue 206 which engages under the edge of a lintel of a box which could, (for example, be formed on the top front edge of the box of FIG. 7) as indicated by the dashed lines 208. The other end of the catch is adapted to fit through a slot in an inner wall of the lid which is diagrammatically indicated by the lines 210 of the Figure. It will be seen that the catch has a flange 212 on one side of the end which passes through the slot, to engage the other side of the wall 210, and projections 214 offset from the end to engage the inside surface of the wall, so that it is firmly located in position.

I claim:

1. A blank of a card material for constructing a box file, which, in the made up form, comprises a pair of similar "half shells" hinged together along a common edge, each half shell comprising a tray like member having a base with an upstanding side wall extending along one edge, and two opposed end walls in the form of right angle triangles, the two half shells being hinged together along a line which defines a top edge of the upstanding side wall of one half shell, and an edge of the base which is opposite the upstanding side wall, of the other half shell, so that when closed, the end walls of the box show a diagonally extending line at a junction of the two half shells; the blank comprising:

(a) a first rectangular portion forming the base of one half shell;

(b) a first inwardly foldable connection section forming a first pair of "double-triangular" flaps, one extending from each end of the first rectangular portion, and each being so shaped as to be foldable to form one of said triangular end walls;

(c) a second rectangular portion, connected by a common edge to a third side of the first rectangular portion, and being narrower than the said first portion so as to form one upstanding side wall;

(d) a second inwardly foldable connection section forming a second pair of "double triangular" flaps connected to opposite sides of the second rectangular portion, and each of which has one side in common and connected to one corresponding side of the adjacent first "double triangular" flap;

(e) a third rectangular portion of the same size as the first rectangular portion, and adapted to form the base of the other half shell and thus the opposite side of the box; and (f) a third inwardly foldable connection section forming a third pair of "double triangular" flaps extending from opposite sides of the said third rectangular portion and each being so shaped as to be foldable to form one of said triangular end walls;

(g) a fourth rectangular portion, adapted to form the opposite side to said second rectangular portion; and (h) a fourth inwardly foldable connection section forming a fourth pair of "double triangular" flaps, each of which is arranged at one end of said fourth rectangular portion, and is connected by one of its other edges to the adjacent edge of the corresponding third "double triangular" flap.

2. A blank according to claim 1 further comprising a fifth large rectangular portion, attached to a "free" edge of the first large rectangular portion, and adapted to be folded over onto it, so as to finish and hold in position the sides of the first half shell, and a sixth, small rectangular portion, corresponding in size to, and connected to the free edge of, the said fourth rectangular portion, so as to correspondingly finish and hold in position the end wall and the triangular side walls of the second half shell.

3. A blank according to claim 2 in which the fifth large rectangular portion is made with additional fold lines to enable it to be folded into a flattened box section to reinforce the free edge of the first large rectangular portion.

4. A blank according to claim 1 further comprising:

an elongate body adapted to project from the inner surface of an internal wall member of a lid of a box formed from the blank adjacent to one edge of said lid and having a tongue portion at its outer end which is adapted to engage behind a flange or lintel portion of a cooperating edge of the box; and, a catch connected to the internal wall member by means of projections which extend from opposite sides of its inner end, and are adapted to lock the catch into a slot in the wall.

5. A blank according to claim 4 in which said inner end is formed with a right-angled flange which forms one of said projections on one side of the inner end, and one or more oppositely projecting studs or detents on the other side which are offset from the end, so that in use, the flange is passed through said slot to engage the other side of said wall member while said studs or detents engage said inner surface of the wall member.

6. A blank for constructing a box file or card index box which, when assembled, has a pair of similar half shells, the blank comprising:

a pair of base members, each base member including a first and a second outwardly extending opposite side portion, wherein the side portions are so shaped that they can be bent up to form triangular side walls, and an adjacent rectangular wall connecting pair of base members, wherein each opposite end of said rectangular wall is joined to an adjacent end of a respective one of the first and second side portions by a respective inwardly foldable connection section so as to form a reinforced right angled corner when the blank is folded into shape; and, a hinge which is of one piece with said pair of base members so that the pair of base members when folded up, form two half shells which are mirror images of each other and wherein each half shell has a pair of opposite triangular side walls, that are complimentary to those of the other half shell, and one side wall which is rectangular, wherein said two half shells, when in a closed configuration, have opposite rectangular ends each of which exhibits a "diagonal cut" line where the corresponding triangular side walls of the two half shells meet and wherein the box can be opened out flat onto a surface.

7. The blank of claim 6 wherein said inwardly foldable connection section comprises a double triangular flap.

8. The blank of claim 7 wherein each of said double triangular flaps comprises:

a first flap section having a first edge connected to a respective end of said rectangular wall and a second edge; and a second flap section having a first edge connected to said first flap section second edge and a second edge connected to a respective one of said first and second outwardly extending opposite side portions.

9. A blank according to claim 6 in which each inwardly foldable connection section is retained in position by folding over it, a further outwardly extending flap portion located on a respective one of the opposite side portions.

* * * * *